US005571036A

United States Patent [19]

Hannigan

[11] Patent Number: 5,571,036

[45] Date of Patent: Nov. 5, 1996

[54] FLEXIBLE TUBE FLOATING SLING

[76] Inventor: Gail Hannigan, 1436 Willowdown Road, Oakville, Ontario, Canada, L6L 1X3

[21] Appl. No.: 360,457

[22] Filed: Dec. 21, 1994

[51] Int. Cl.[6] ..... B63C 9/08

[52] U.S. Cl. ..... 441/129; 441/132

[58] Field of Search ..... 441/74, 129, 130, 441/131, 132, 35, 40; 114/345, 357

[56] References Cited

U.S. PATENT DOCUMENTS

| | | | |
|---|---|---|---|
| 1,562,276 | 11/1925 | Assenzio | 441/132 |
| 1,567,555 | 12/1925 | Straussler | 441/130 |
| 3,117,327 | 1/1964 | Mathew | 441/132 |
| 4,693,691 | 9/1987 | DeYoe | 441/129 |
| 4,894,033 | 1/1990 | Chang | 441/130 |
| 4,976,642 | 12/1990 | Wilkie | 441/131 |
| 5,162,007 | 11/1992 | Leslie | 441/129 |
| 5,308,271 | 5/1994 | Foulke | 441/74 |

FOREIGN PATENT DOCUMENTS

| | | | |
|---|---|---|---|
| 272189 | 7/1934 | Italy | 441/132 |

*Primary Examiner*—Stephen Avila
*Attorney, Agent, or Firm*—James W. Carson

[57] ABSTRACT

The present invention provides an improved floatation support comprising one or more buoyant flexible foam tubes having first and second ends. A sling having first and second sides is connected to the first and second ends of the foam tube(s) so that they may be retained in a U-shape so that a person can lie or sit on the sling. The sling is attached to the foam tube in such a way as to pull the two ends of the tube together. This creates a comfortable platform on which a person can lie down either in the supine or prone position, typically with the head at the "U" bend in the tube and resting around the middle of the U Bend. The U bend provides means to support the head in the water, as this is the point of greatest buoyancy. The weight of the person on the sling is distributed evenly across the sling with the foam tube on both sides, resulting in good floatation characteristics and stability. A low center of gravity results because the weight of the user pulls down the center of the sling.

7 Claims, 4 Drawing Sheets

FLEXIBLE TUBE FLOATING SLING

BACKGROUND OF THE INVENTION

1. Field of the Invention

The present invention relates to improvements in devices for recreational or body-support floatation in water using a flexible foam tube or tubes and a fabric or mesh sling.

2. Description of the Prior Art

Body support of an individual in the water for the purposes of recreational floatation or body-support may currently be accomplished by a number of different means.

The use of recreational floatation devices is widespread. Most popular are a very large number of inflatable products composed of flexible air-impermeable material such as vinyl plastic. The water mattress as described in U.S. Pat. Nos. 2,068,134, 2,939,158 and 3,068,494 are common examples. These inflatable air mattress products may be simple and inexpensive or elaborate and expensive. Inflatable products are distributed in many shapes based such as, for example, dinosaurs, lobsters, whales and many others. Adaptations may provide for example, leg holes, handle grips, drinking glass holders and clear plastic viewing windows to look through into the water under the inflatable.

Other features have been designed into inflatable air mattresses. U.S. Pat. No. 4,723,329 describes a device said to improve the posturepedic qualities of an air mattress, incorporating two separate air chambers and other improvements.

These inflatable devices all suffer from a number of disadvantages. They all must be inflated, such as by using a pump or by the user blowing into a valve. Over-inflation or under-inflation is always a concern. They are typically plastic or water impermeable cloth fabric construction and when punctured loose buoyancy partially or completely. A puncture must be repaired to afford full usefulness to the device. Construction typically involves seams, which may be difficult to repair if a puncture or tear occurs on a seam. The inclusion of repair kits with available inflatable flotation devices is very common.

A second type of floatation lounger is a type of construction using a rigid or semi-rigid foam slab material. These are typically composed with two large opposing flat surfaces. There may be a foam pillow or such support incorporated at one end for head and neck support. A disadvantage of this type of product is that lying on the foam slab results in a high centre of gravity above the surface of the water. Thus it is very easy to tip about the centre axis of the device or to lose balance while moving about while on the slab.

U.S. Pat. No. 5,162,007 describes a water lounger or water mattress having stacked layers of air-bubble sheet plastic encased in flexible plastic sheet or mesh. This design may provide for lower centre of gravity and better stability while in the lying on the device in the water. However, this mattress design is bulky and may not be easily folded or disassembled for storage. Further, during use, accidental puncture or slitting of the outer water impermeable plastic vinyl sheet cover would result in water entering between the outer layer and inner construction. This could cause some loss of floatation. This water contamination would also be difficult, if not impossible, to remove and could result in problems such as bacterial or algae growth or moulding eventually within the layers of the device construction.

Another type of recreational water lounging product consists of some type of chair, such as a lawn chair construction, with buoyant means, such as rigid styrofoam attached to the chair. These devices have the disadvantage that they are bulky and may use metal frames, for example, aluminum tube frame, which may bend or crack. Typically, metal bolts are also used in the aluminum frame, which are subject to rusting or decay with use, especially when used in recreational pool water containing traces of chlorine for water. This type of water lounger also tends to be expensive.

Recently, an extruded foam tube has been found to be useful as a pool toy and floatation aid. However, this semi-rigid straight tube construction has not been useable as a lounge device.

SUMMARY OF THE INVENTION

An object of the present invention is to provide a simple and inexpensive floatation device for buoyancy of an individual in the water without the need for inflatable, flat slab, mattress-style or lawn chair type means.

Another object of the present invention is to provide an floatation support which has improved stability in the water and will not lose its buoyancy if punctured.

Another object of the present invention is to provide an improved device which consists of a minimum number of parts that is lightweight and easily disassembled to facilitate storage of the device.

Thus, in accordance with the present invention, there is provided an improved floatation support comprising floatation means consisting of one or more flexible foam tubes having first and second ends. Sling means having first and second sides is provided with connector means at said first and second sides of the sling means. The foam tube(s) may be retained in a U-shape by attaching the connector means to the first and second ends of the tube so that a person can lie or sit on the sling means.

The sling is attached to the foam tube in such a way as to pull the two ends of the tube together. This creates a comfortable platform on which a person can lie down either in the supine or prone position, typically with the head at the "U" bend in the tube and resting around the middle of the U Bend. The U bend provides means to support the head in the water, as this is the point of greatest buoyancy. The weight of the person on the sling is distributed evenly across the sling with the foam tube on both sides, resulting in good floatation characteristics and stability. A low centre of gravity results because the weight of the user pulls down the centre of the sling. This allows full body support in the water utilizing the floatation properties of the foam tube, without the need to grasp the foam tube. However, one may conveniently rest the arms on one or both sides of the device.

Further features of the invention will be described or will become apparent in the course of the following detailed description.

BRIEF DESCRIPTION OF THE DRAWINGS

In order that the invention may be more clearly understood, the preferred embodiment thereof will now be described in detail by way of example, with reference to the accompanying drawings, in which.

DETAILED DESCRIPTION OF THE PREFERRED EMBODIMENT

Referring to FIGS. 1 to 4, the floatation support of the present invention is generally indicated at 1. The floatation means 2 consists of one or more flexible foam tubes 3, preferably one, having first and second ends 4 and 5 respectively. The tube 3 is preferably formed of a closed-cell extruded polymer such as polypropylene, polyethylene or polystyrene and while preferably has a substantially round cross section, may be any shape (square, triangular, rectangular, irregular or polyhedral cross section) provided the required buoyancy characteristics are maintained. A single tube or a plurality of tubes may be used. The density, diameter and volume of the foam tube will determine the floatation characteristics of the support and accordingly the number and shape of the tube 3 will depend on the characteristics required.

Figure 1:
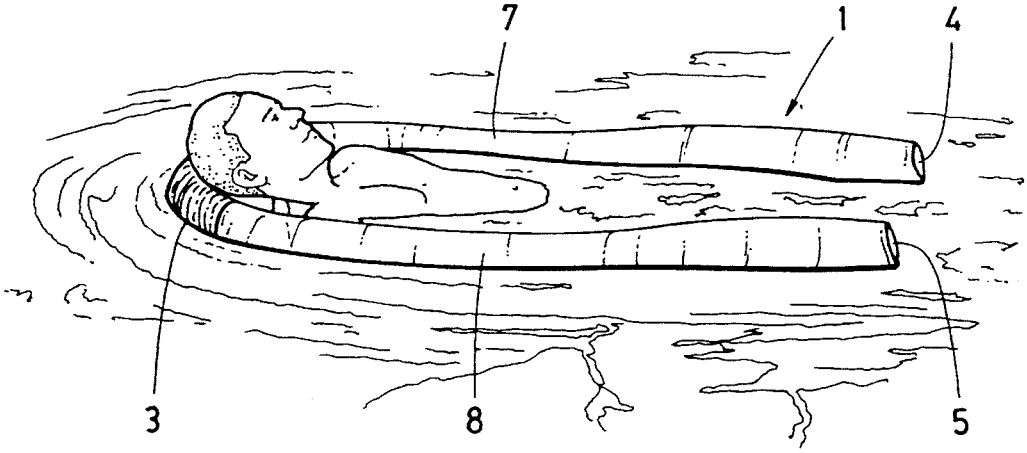
FIG. 1 is a perspective view of a floatation support according to the present invention in use by a person lying on their back.
Figure 2:
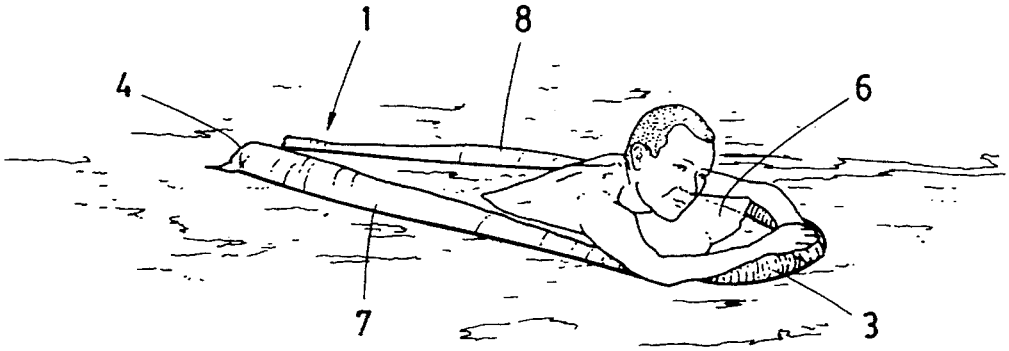
FIG. 2 is a perspective view of a floatation support according to the present invention in use by a person lying on their stomach.
Figure 3:
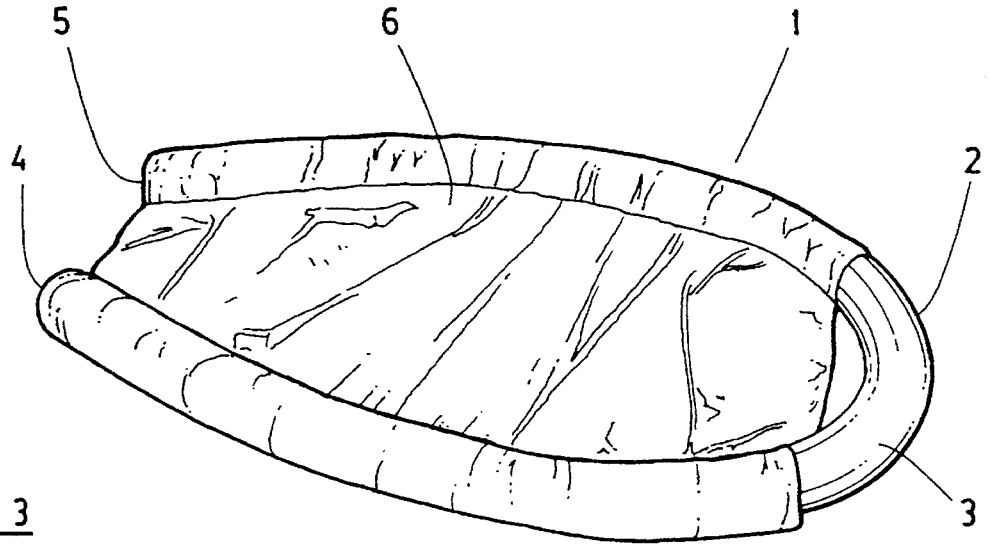
FIG. 3 is a top view of the floatation support of FIG. 1 and 2.
Figure 4:
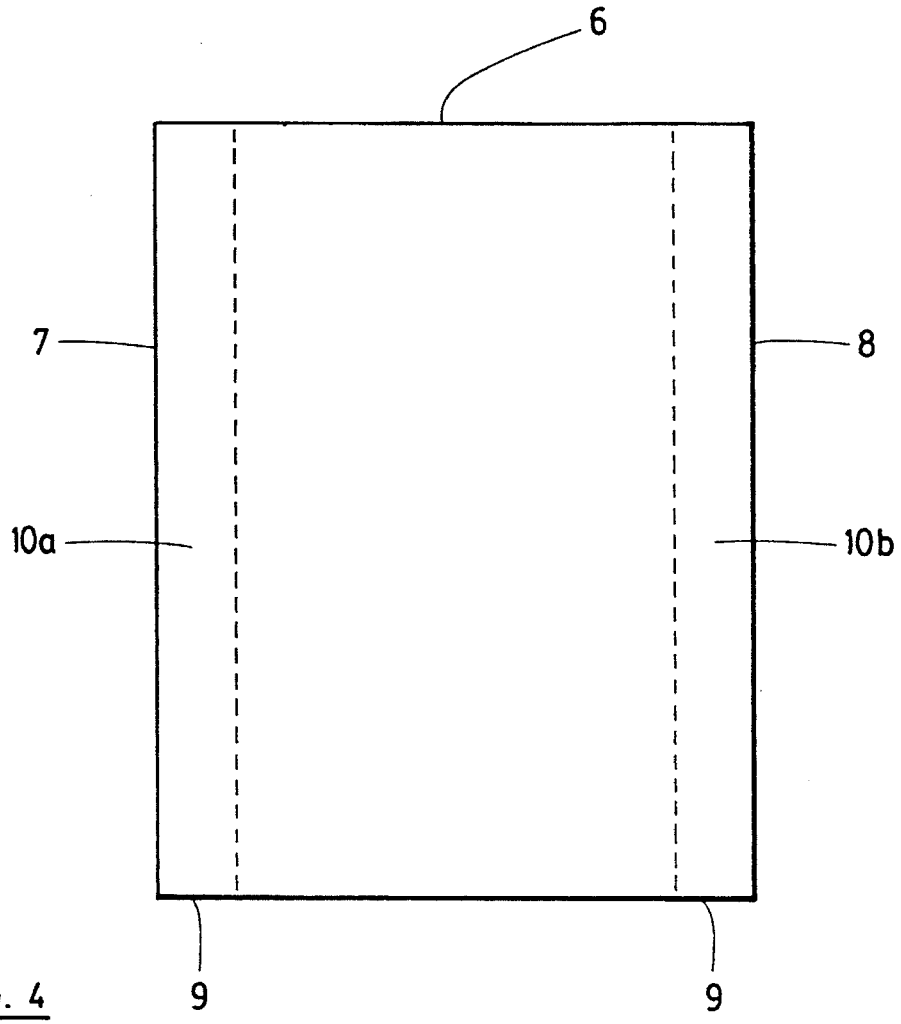
FIG. 4 is a plan view of the sling for the floatation support of FIG. 1 and 2.

Sling means 6 has first and second sides 7 and 8. The sling means is preferably made of a fabric or mesh net such as 100% nylon fabric or any suitable fabric, which may or may not be water repellant, may be UV stabilized and/or coated fabric, for example polyurethane coated nylon. In the preferred embodiment the sling is formed from a rectangular piece of material as shown in FIG. 4.

Figure 5:
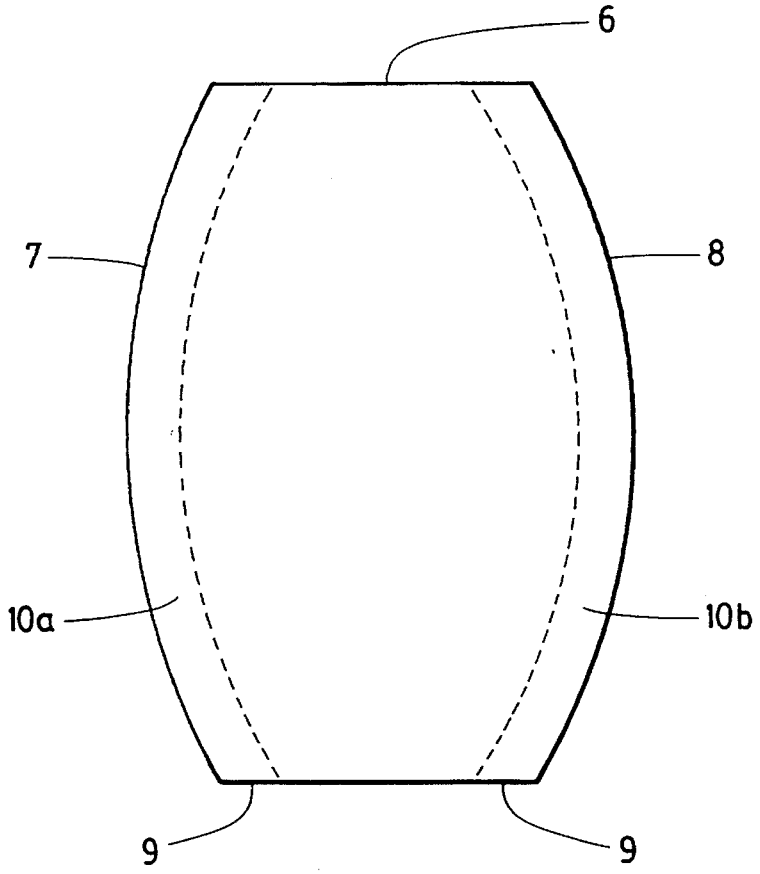
FIG. 5 is a plan view of an alternative embodiment of the sling for the floatation support of FIG. 1 and 2.

Connector means 9 is provided at said first and second sides, 7 and 8, of the sling means 6. In the preferred embodiment, the fabric or mesh net of sling means 6 is formed into sleeves 10*a* and 10*b* along sides 7 and 8. The ends 4 and 5 of tube 3 are inserted into the sleeves 10*a* and 10*b*. By using a single semi-rigid foam tube preferably of closed cell polyethylene, the foam tube is substantially straight. When the tube is bent into a concentric U shape, and the ends are inserted into the sleeves at the sides of the sling, the properties of the semi-rigid closed cell foam tube result in the tube wanting to return to its natural un-bent state. This results in the ends of the tube putting the sling in tension to help hold the tube in the sleeves. The sleeves 10*a* and 10*b* can be straight or can be curved or curved as shown in FIG. 5. In another embodiment not shown the connector means can be adapted so that the ends of the tube(s) join forming an oval.

The floatation support has excellent stability and lounging qualities in the water and creates a comfortable platform on which a person can lie down either in the supine or prone position, typically with the head at the "U" bend in the tube and resting around the middle of the U Bend. The U bend provides means to support the head in the water, as this is the point of greatest buoyancy. The weight of the person on the sling is distributed evenly across the fabric with the foam tube on both sides, resulting in good floatation characteristics and stability. A low centre of gravity results because of the way the weight of the user pulls down the centre of the sling. This allows full body support in the water utilizing the floatation properties of the foam tube, without the need to grasp the foam tube. However, one may conveniently rest the arms on one or both sides of the device.

Figure 6:
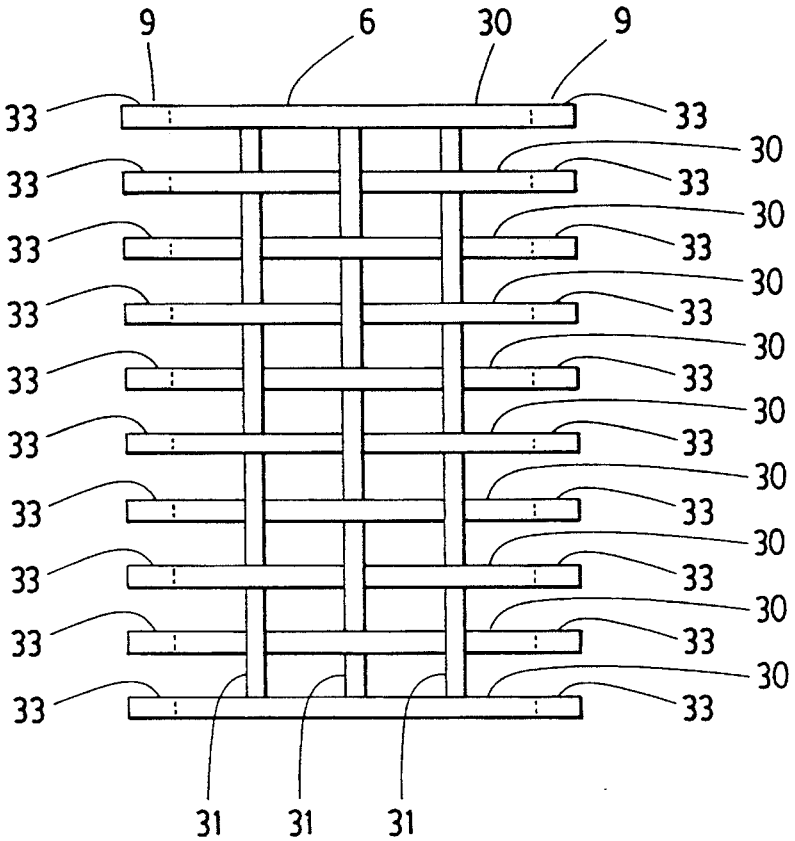
FIG. 6 is a plan view of an alternative embodiment of the sling for the floatation support of FIG. 1 and 2.

Other means may be used to connect the sling and tube. For example it is possible to use hook and loop velcro type attachments or a casing with elasticized or draw-string means about the tube. If the sling means consists of a series of parallel horizontal and vertical strips 30, 31 woven as shown in FIG. 6, similar to a lawn chair, loops 33 can be provided in opposite ends of the horizontal strips 30 into which the ends of the tube can be inserted.

In the preferred embodiment the floatation means consists of a tube of closed cell polyethylene of 3½ inches diameter and about 12 feet in length. The sling means is made of 100% nylon 60 inches long by 46 inches wide. The material is looped over at the edges and stitched using twelve inches on opposite sides to form two sleeves of approximately 12 inches in circumference. The ends of the tube are inserted into the sleeves so that the tube is bent around in a U shaped configuration.

A casing and drawstring or casing and elastic may be provided on the sleeves to secure the upper edges of the sleeve around the tube to prevent slippage down the tube. In addition a casing and drawstring can be added along the edge of the sling facing the U-bend in the foam tube providing a means to adjust the sling tension on the upper edge of the sling. Typically the ends of the extruded closed cell foam tube cut from a longer section are not closed and may absorb some water. When storing it is convenient to hang the tube with the open ends down to permit any water that has been absorbed to drain from the ends. Alternatively the ends may be treated to prevent water absorption.

Figure 7:
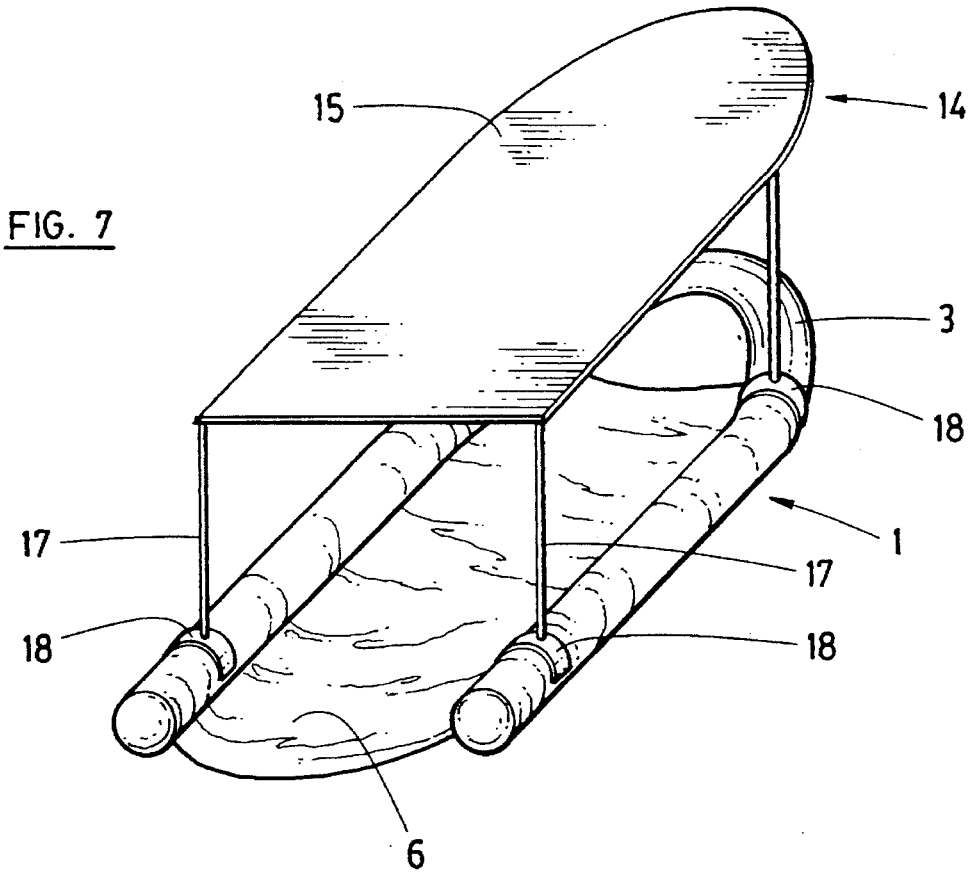
FIG. 7 shows a canopy attachment for the floatation support of FIG. 1.
Figure 8:
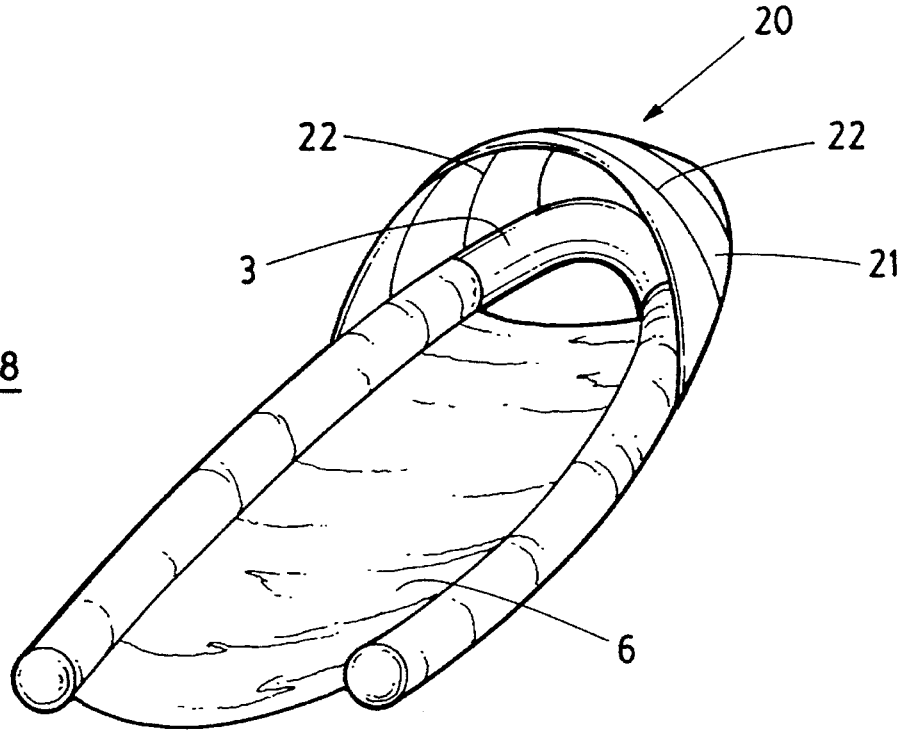
FIG. 8 shows another canopy attachment for the floatation device of FIG. 1.

Referring to FIGS. 7 and 8, to provide protection from sun while in use, there may be a canopy attachment 14 such as illustrated in FIG. 7 provided. The canopy attachment 14 has a fabric or mesh canopy 15 supported on vertical uprights 17 which are equipped with inverted U ends 18 for connection to the foam tube 3.

An alternative form of canopy attachment 20 is illustrated in FIG. 8. The canopy means 21 is formed from a substantially semi-circle of material and provided with a series of parallel flexible ribs 22. The canopy 21 is flexed to form an arch over the U-bend in the foam tube.

No inflation is involved in the present invention and a puncture to the foam tube or to the sling will not result in any significant loss of function for the device.

The floatation support can easily be disassembled by removing the tube from the sling, and the tube will typically return to a straight shape for storage. It is lightweight and simple to assemble and disassemble. The sling may be slid off the tube for cleaning, storage, or replacement. The tube may be replaced, for example, with a different coloured foam.

The sling material may preferably be of a waterproof type material and may be attached around the tube on each side in such a way that when out of the water, the entire device will dry very quickly and completely with no opportunity for mould growth to occur. The tube, typically constructed of closed cell polyethylene, polypropylene or polystyrene blown foam is substantially waterproof and dries quickly when out of the water.

It will be appreciated that the above description related to the preferred embodiment by way of example only. Many variations on the invention will be obvious to those knowledgeable in the field, and such obvious variations are within the scope of the invention as described and claimed, whether or not expressly described.

What is claimed as the invention is:

1. A flotation support including an elongate resilient and flexible foam tube folded about itself into a generally U-shaped configuration defining a pair of leg portions movable between generally parallel and generally converging portions and interconnected by a generally arcuate bight portion when in use; sling means extending between said leg portions and including opposite side edges secured to said leg portions of said foam flotation support and defining complementary sleeve means within which said leg portions of said foam tube are positioned and retained; and a head supporting portion of said flotation support defined by said arcuate bight configured to conform to the user anatomy to support the head of a user positioned on the sling to elevate the head above the water and the user's body in a generally supine position.

2. A floatation support according to claim 1 wherein said foam tube is a closed cell polyethylene, polypropylene or polystyrene blown foam extrusion.

3. A floatation support according to claim 1 wherein said sling means is formed of waterproof fabric.

4. A floatation support according to claim 1 wherein said sling means is formed of mesh net.

5. A floatation support according to claim 1 wherein said sling means is formed of a series of parallel strips.

6. A floatation support according to claim 2 wherein the flexible foam tube and sling means can be submerged at the open end of the U-shape to facilitate a person laying or sitting on said sling.

7. A floatation support according to claim 6 wherein a person laying or sitting on said sling means is partially submerged to maintain a low centre of gravity and provide the support with stability.

* * * * *